US010350590B2

(12) United States Patent
Ramsamy

(10) Patent No.: US 10,350,590 B2
(45) Date of Patent: Jul. 16, 2019

(54) SAMPLING PIPETTE HAVING AN ERGONOMIC CONTROL BUTTON

(71) Applicant: Gilson SAS, Villiers-le-Bel (FR)

(72) Inventor: Sanjay Ramsamy, Sarcelles (FR)

(73) Assignee: GILSON SAS, Villiers-le-Bel (FR)

( * ) Notice: Subject to any disclaimer, the term of this patent is extended or adjusted under 35 U.S.C. 154(b) by 320 days.

(21) Appl. No.: 15/516,159

(22) PCT Filed: Oct. 1, 2015

(86) PCT No.: PCT/EP2015/072654
§ 371 (c)(1),
(2) Date: Mar. 31, 2017

(87) PCT Pub. No.: WO2016/050896
PCT Pub. Date: Apr. 7, 2016

(65) Prior Publication Data

US 2017/0304817 A1 Oct. 26, 2017

(30) Foreign Application Priority Data

Oct. 3, 2014 (FR) ..... 14 59492

(51) Int. Cl.
*B01L 3/02* (2006.01)

(52) U.S. Cl.
CPC ..... *B01L 3/0286* (2013.01); *B01L 3/0217* (2013.01); *B01L 2200/087* (2013.01)

(58) Field of Classification Search
CPC ..... B01L 2200/087
See application file for complete search history.

(56) References Cited

U.S. PATENT DOCUMENTS 4,096,750 A 6/1978 Sturm
4,099,548 A 7/1978 Sturm
4,584,510 A * 4/1986 Hollow ..... B64C 13/04 244/234
6,295,880 B1 * 10/2001 Gilson ..... B01L 3/0224 73/864.18

(Continued)

FOREIGN PATENT DOCUMENTS

DE 27 36 551 A1 3/1978
WO 98/20973 A2 5/1998

(Continued)

OTHER PUBLICATIONS

Search Report issued in French Patent Application No. 1459492 dated May 18, 2015.

(Continued)

*Primary Examiner* — Daniel S Larkin
*Assistant Examiner* — Anthony W Megna Fuentes
(74) *Attorney, Agent, or Firm* — Pearne & Gordon LLP

(57) ABSTRACT

An assembly (3) for an ergonomic sampling pipette including a control rod (10) at the end of which is arranged a control button (12) for controlling the movement of the control rod (10) along a longitudinal axis (18) thereof, the button (12) having a pressure surface (11) for receiving the thumb of an operator. The pressure surface (11) of the control button (12) is movable such as to be able, during operation, to assume multiple angles relative to the longitudinal axis (28) of the control rod (10).

12 Claims, 3 Drawing Sheets

(56) References Cited

U.S. PATENT DOCUMENTS

2003/0147781 A1* 8/2003 Viot ..... B01L 3/0279
422/525

FOREIGN PATENT DOCUMENTS

WO 01/42759 A1 6/2001
WO 02/00346 A2 1/2002

OTHER PUBLICATIONS

International Search Report issued in Application No. PCT/EP2015/072654 dated Jan. 7, 2016.
Written Opinion issued in Application No. PCT/EP2015/072654 dated Jan. 7, 2016.

* cited by examiner

SAMPLING PIPETTE HAVING AN ERGONOMIC CONTROL BUTTON

The present invention relates to the field of sampling pipettes, also referred to as laboratory pipettes or liquid transfer pipettes. They are intended for the sampling and dispensing of liquid in containers or similar.

The invention relates more specifically to manual, single-channel or multi-channel pipettes. In a known manner, manual pipettes are intended to be held in the hand by an operator during liquid sampling and dispensing operations, these operations being carried out by actuating the movement of a control button obtained by applying an axial pressure on said button. The axial pressure applied to the control button is transmitted to a piston of the pipette, via a control rod of the pipette. The piston is subject to axial displacement and induces a displacement of air resulting in the sampling and dispensing operations. This principle relates to so-called air displacement pipettes, wherein a sampling cone is intended to be removably mounted on the tip of the pipette. Nevertheless, the invention also applies to so-called positive displacement pipettes, intended to engage with capillary-piston type consumables, wherein the piston is envisaged to be directly in contact with the sample to be taken, before being ejected or reused. Positive displacement pipettes therefore have a different design to that of more conventional air displacement pipettes, wherein the piston is an integral part of the pipette.

Regardless of the design adopted, there is a constant need to improve the ergonomics of these pipettes, in particular in order to facilitate the movements of the operator's thumb during liquid dispensing or intake operations, as well as during draining. Indeed, at the start of the downward travel of the control rod, the operator's inclined thumb only has a small contact area with the button, which obliges the operator to develop a significant force in order to generate the sought displacement. This may give rise to pipetting comfort problems, as well as the appearance of musculoskeletal disorders (MSD).

In order to address this need, the invention relates to an assembly for an ergonomic sampling pipette including a control rod at the end of which is arranged a control button for controlling the movement of the control rod along a longitudinal axis thereof, the button having a pressure surface for receiving the thumb of an operator. According to the invention, the pressure surface of the control button is movable such as to be able, during operation, to assume multiple angles relative to the longitudinal axis of the control rod.

In other words, an additional degree of freedom is introduced at the control button, such that in operation, the angle of the pressure surface thereof adapts to the changeable angle of the distal phalanx of the thumb of the operator holding the pipette in the hand. By means of this additional degree of freedom, the position of the pressure surface is thus capable of changing to follow the natural rotational movement of the distal phalanx of the thumb, relative to the proximal phalanx, during the descent and ascent of the control rod. This results in superior pipetting comfort, with particularly superior strain distribution on the thumb joints, and a force of lower intensity to be developed to induce the descent of the control rod via the button. This is conveyed by a reduction in muscle fatigue, as well as a limitation of the risks of the onset of musculoskeletal disorders.

The invention has at least one of the following features, taken alone or in combination.

The control button is pivotally mounted on the control rod, along a pivoting axis arranged in a plane orthogonal to the longitudinal axis of the control rod. Alternatively, the control button could be made of two parts, including a base mounted on the control rod, and a movable end part pivotally mounted on the base, and including said pressure surface intended to be contacted by the thumb.

The control button is pivotally mounted between two end positions, switching from one to the other of the two end positions being performed by pivoting by a total range of rotation between 10 and 45°, and more preferentially between 15 and 25°.

The assembly includes means for returning the pressure surface to a rest position, which can equally be one or the other of the two end positions cited above.

The pressure surface has a convex shape so as to define a cradle for receiving the operator's thumb.

The convexity axis of the pressure surface of the control button is substantially orthogonal to a pivoting axis of the control button.

The invention also relates to a sampling pipette including such an assembly, the pipette being of the air displacement or positive displacement type, and of the single-channel or multi-channel type.

Further advantages and features of the invention will emerge in the non-limiting detailed description hereinafter.

The description will make reference to the appended drawing wherein.

Figure 1:
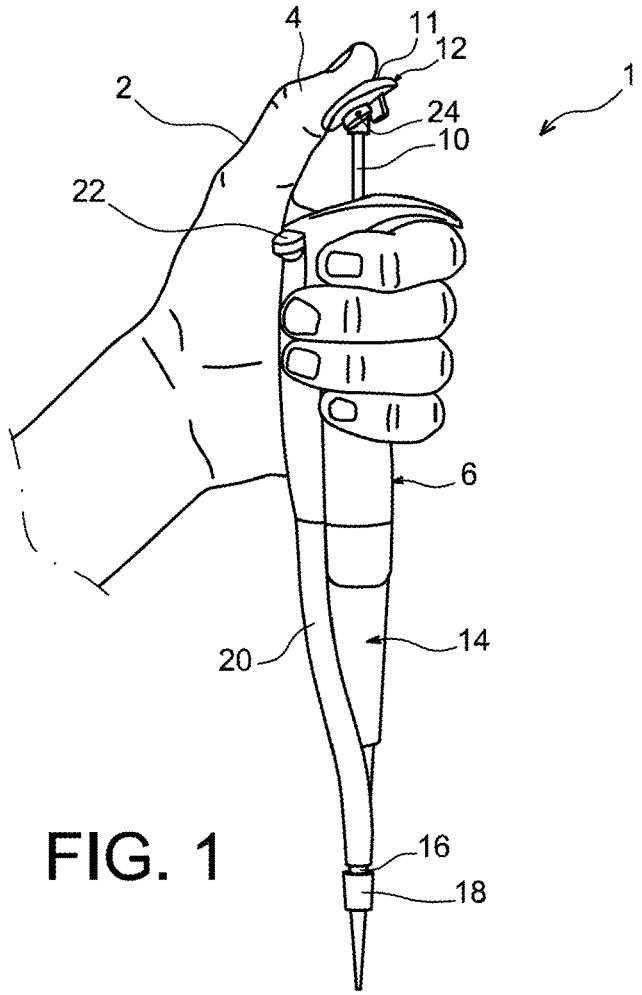
FIG. 1 represents a perspective view of an air displacement sampling pipette, according to a preferred embodiment of the present invention.

With reference first of all to FIG. 1, a manually actuated air displacement sampling pipette 1 is represented, according to a preferred embodiment of the present invention. Hereinafter in the description, the terms "top" and "bottom" are to be considered with the pipette held upright, in the pipetting position or close to this position.

In FIG. 1, the pipette 1 held by the hand 2 of an operator, who, using the thumb 4, actuates the pipette to induce the dispensing of a previously aspirated liquid, is represented.

More specifically, the pipette 1 includes a handle 6 acting as the upper body of the pipette, from which handle a pipetting control rod 10 emerges bearing at the top end thereof, in the pipetting position, a control button 12 wherein the top part is intended to be subjected to the pressure of the operator's thumb. More specifically, the button has a pressure surface 11 intended to receive the operator's thumb, this surface generally facing upwards.

By way of indication, it is noted that a display screen (not shown) can be provided on the handle 6. Similarly, means for setting the volume to be sampled are also accessible to the operator on this handle 6.

Below the handle 6, the pipette 1 includes a removable bottom part 14, which ends at the bottom with a cone-holder tip 16 receiving a consumable 18, also referred to as a sampling cone. In a known manner, after pipetting, the cone can be ejected mechanically by an ejector 20 wherein the actuation button 22 is situated for example projecting on the top of the handle, in the vicinity of the control button 12.

Figure 2:
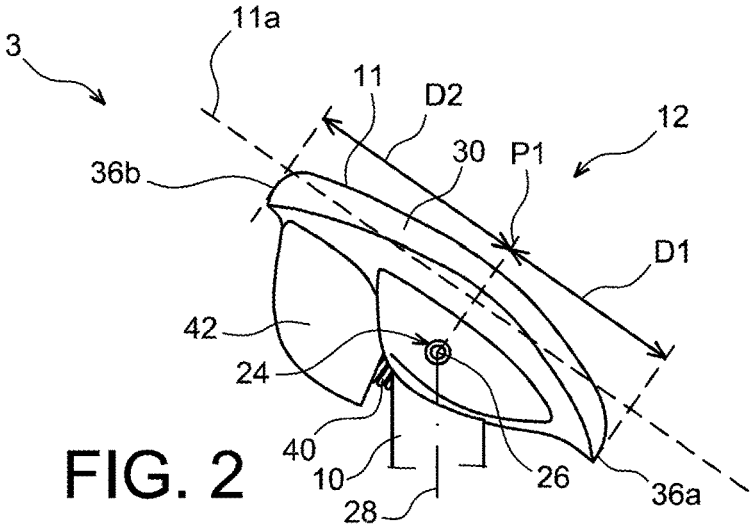
FIG. 2 represents a more detailed side view of the control button of the pipette shown in the preceding figure.
Figure 3:
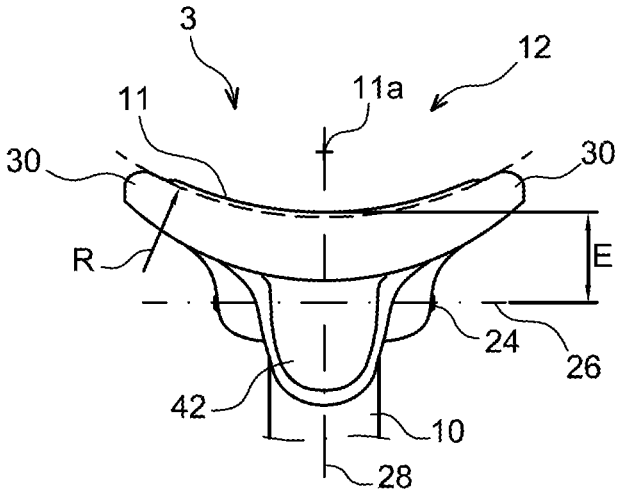
FIG. 3 represents a rear view of the control button shown in the preceding figure.

FIGS. 2 and 3 show in more detail the control button 12, pivotally mounted at the top end of the control rod 10. To carry out such pivoting, a piece 24 passes through both the rod 10 and the bottom part of the button 12. The piece 24 is oriented along a pivoting axis 26, orthogonal to the longitudinal axis 28 of the control rod, and arranged in a plane orthogonal to said axis 28. The latter also corresponds to the longitudinal axis of the pipette, as well as to the direction of displacement of the rod 10 during the pipetting operations.

It is noted that in a preferred embodiment of the invention, the pair referenced 10 in FIGS. 2 and 3 does not form the top end of the control rod, but alternatively forms a part of the button 12. Indeed, the control button could be made of two parts, including a base mounted on the control rod and corresponding to the element referenced 10 in FIGS. 2 and 3, and a movable end part pivotally mounted on the base, via the piece 24.

The button 12 therefore has a convex pressure surface 11 so as to define a cradle for receiving the operator's thumb. This cradle assumes a cylindrical shape, having two raised edges 30 to prevent lateral sliding of the thumb. These two edges 30 are arranged on either side of a convexity axis 11*a* of the surface 11, this axis 11*a* being orthogonal to the pivoting axis 26.

The radius of curvature R of the surface 11 is for example of the order of 20 mm. Moreover, the spacing E between the pivoting axis 26, and the bottom of the cradle defined by the surface 11, is of the order of 3 to 5 cm, and preferentially approximately 4 cm. Furthermore, the distance D1 from a transversal plane P1 of the button 12 incorporating the pivoting axis 26, to a first end 36*a* of said button 12, is between 10 and 14 cm, and preferably of the order of 12 cm. Said first end 36*a* corresponds to an end along the convexity axis 11*a*, and more specifically to that intended to engage with the anterior part of the distal phalanx of the operator's thumb. In addition, the distance D2 from the transversal plane P1 to a second end 36*b* of the button 12 is between 13 and 17 cm, and preferably of the order of 15 cm. Said second end 36*b* is opposite the first along the convexity axis 11*a*, and therefore corresponds to that intended to engage with the posterior part of the distal phalanx of the thumb.

The assembly 3 according to the invention, including the button 12 and the rod 10, is also equipped with means 40 for returning the button to a rest position, shown in FIGS. 2 and 3. This consists preferably of a compression spring 40 inserted between a protuberance 42 of the button, and the top part of the control rod 10.

In this regard, it is noted that in the embodiment described above, wherein the control button is made of two parts with the base thereof corresponding to the element referenced 10 in FIGS. 2 and 3, the spring 40 is then bearing on said base. The base advantageously offers a larger surface area than that of the rod to receive the spring 40. The base assumes for example a tubular shape mounted about the top end of the control rod, the piece 24 then passing through the base and the top part of the button, as shown in FIG. 1.

The spring 40 therefore returns the button to a rest position which corresponds to a position wherein it has a maximum angle relative to a plane orthogonal to the longitudinal axis 28. This consists of one of the two end positions of a pivoting movement of the button 12 along the axis 26.

By means of this pivoting movement, the button 12 can thus assume a plurality of angles during the pipetting operations, by adapting to the changeable position of the distal phalanx of the operator's thumb.

Figure 4:
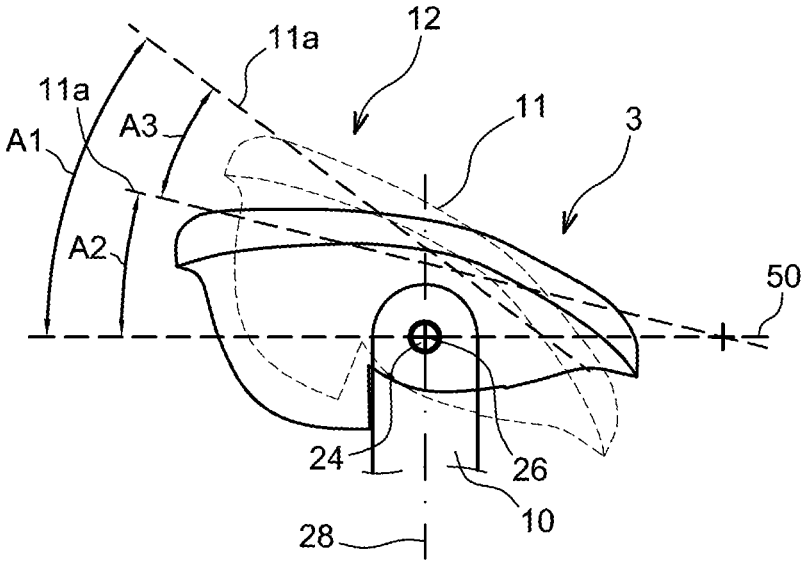
FIG. 4 represents a view schematically representing the two end positions of the control button.
Figure 5:
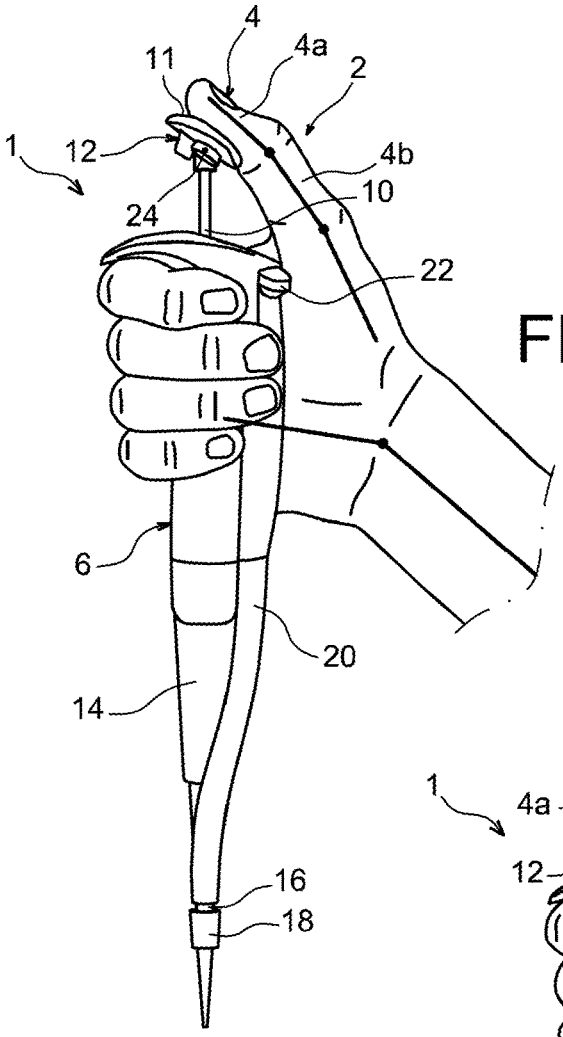
FIG. 5 represents the pipette held by the operator at the time of an end of liquid intake travel, the time at which the button adopts one of the two end positions.

In FIG. 4, the button 12 has been represented in the two end positions of the permitted pivoting movement thereof about the axis 26. The most inclined position represented with a dotted line, corresponding to that previously shown in FIG. 2, is such that the angle A1 between the horizontal 50 and the convexity axis 11*a* is of the order of 35°. In this regard, it is noted that in FIG. 4, the line 50 represents both the horizontal and a plane orthogonal to the axis 28. An angle A1 greater than 35° is possible, but liable to induce parasitic radial loads on the rod 10. This position is adopted when the rod is at the top stop, i.e. at the end of the sampling operation, and before the start of the dispensing operation. Indeed, in this design shown in FIG. 5, the angle between the distal phalanx 4*a* and the proximal phalanx 4*b* is small. The distal phalanx 4*a* is therefore found to be significantly inclined with respect to the horizontal, but the pivoting pressure surface 11 makes it possible to adapt perfectly to this particular orientation of the phalanx 4*a*, while being in turn inclined. In this position, the cradle of the button thus receives the phalanx 4*a* wherein the longitudinal axis is advantageously parallel to the convexity axis 11*a*.

This shape complementarity is retained during all the pipetting operations, by means of the pivoting nature of the button 12 which can follow the rotary movement of the distal phalanx 4*a*, relative to the proximal phalanx 4*b*.

Figure 6:
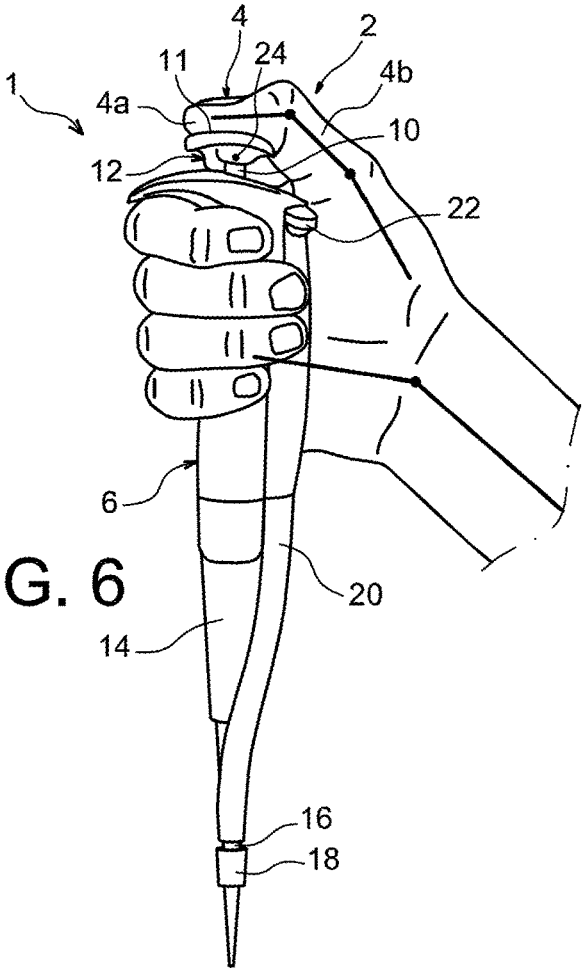
FIG. 6 represents the pipette held by the operator at the time of an end of liquid drainage travel, the time at which the button adopts the other of the two end positions.

In FIG. 4, the button 12 has also been represented in the other of the two end positions of the pivoting movement thereof about the axis 26. This consists of the least inclined position, approaching the fixed position encountered in conventional pipettes. This second end position is that wherein the angle A2 between the horizontal 50, and the convexity axis 11*a*, is of the order of 15°. A lesser angle is possible, but less ergonomic due to the significant angle required between the distal and proximal phalanxes 4*a*, 4*b*. This position is adopted when the rod is at the bottom stop, i.e. at the end of the dispensing operation or at the end of the draining operation. Indeed, in this design shown in FIG. 6, the angle between the distal phalanx 4*a* and the proximal phalanx 4*b* is relatively large. The distal phalanx 4*a* is thus found to be slightly inclined with respect to the horizontal, but always perfectly received in the cradle of the button oriented accordingly.

The total angle of rotation A3 of the button 12 is thus of the order of 20°, and more generally between 15 and 25°. The switch from the first end position to the second end position is performed by countering the return force developed by the spring 40, this force being preferentially very low so as not to affect the ergonomics of the pipette. Mechanical stop systems make it possible to limit the pivoting movement of the button 12 between the two end positions cited above. Moreover, it is noted that according to the size of the operator's thumb, the pipetting operations can be carried out without reaching one and/or the other of the two end positions, but always observing an adaptation of the angle of the button 12 according to the changeable position of the distal phalanx 4*a* of the operator's thumb.

Obviously, various modifications can be made by those skilled in the art to the invention described above, merely by way of non-limiting examples.

What is claimed is:

1. An assembly for a sampling pipette including a control rod at the end of which is mounted a control button for controlling the movement of the control rod along a longitudinal axis of the control rod, the button having a pressure surface for receiving the thumb of an operator, wherein the control rod and the control button are translatable together along the longitudinal axis, and the pressure surface of the control button is movable such as to be able, during operation, to assume multiple angles relative to the longitudinal axis of the control rod.

2. The assembly according to claim 1, wherein the control button is pivotally mounted on the control rod, along a pivoting axis arranged in a plane orthogonal to the longitudinal axis of the control rod.

3. The assembly according to claim 2, wherein the control button is pivotally mounted between two end positions, switching from one to the other of the two end positions being performed by pivoting by a total range of rotation between 10 and 45°.

4. The assembly according to claim 3, wherein switching from one to the other of the two end positions being performed by pivoting by a total range of rotation between 15 and 25°.

5. The assembly according to claim 2, wherein the pivoting axis and control rod are movable together in translation along the longitudinal axis.

6. The assembly according to claim 1, further including means for returning the pressure surface to a rest position.

7. The assembly according to claim 1, wherein the pressure surface has a convex shape so as to define a cradle for receiving the operator's thumb.

8. The assembly (3) according to claim 7, wherein the convexity axis of the pressure surface of the control button, is substantially orthogonal to a pivoting axis of the control button.

9. A sampling pipette including the assembly according to claim 1.

10. The sampling pipette according to claim 9, wherein the sampling pipette is of the air displacement or positive displacement type.

11. The sampling pipette according to claim 10, wherein the sampling pipette is single-channel or multi-channel.

12. The sampling pipette according to claim 9, wherein the sampling pipette is single-channel or multi-channel.

* * * * *